US007639979B2

(12) United States Patent
Murrell et al.

(10) Patent No.: US 7,639,979 B2
(45) Date of Patent: Dec. 29, 2009

(54) PRECONDITIONING MEDIA SHEETS TO REDUCE TRANSFER VOLTAGE

(75) Inventors: Niko Jay Murrell, Lexington, KY (US); Robert Reed Booth, Lexington, KY (US); Larry Steven Foster, Lexington, KY (US); Brian P. Weaver, Shelbyville, KY (US)

(73) Assignee: Lexmark International, Inc., Lexington, KY (US)

( * ) Notice: Subject to any disclaimer, the term of this patent is extended or adjusted under 35 U.S.C. 154(b) by 153 days.

(21) Appl. No.: 11/692,286

(22) Filed: Mar. 28, 2007

(65) Prior Publication Data

US 2008/0240761 A1 Oct. 2, 2008

(51) Int. Cl.
*G03G 15/16* (2006.01)

(52) U.S. Cl. ..... 399/390; 399/66; 399/297

(58) Field of Classification Search ..... 399/66, 399/296, 297, 298, 299, 310, 314, 388, 390, 399/401

See application file for complete search history.

(56) References Cited

U.S. PATENT DOCUMENTS

| | | | | |
|---|---|---|---|---|
| 4,162,843 | A * | 7/1979 | Inoue et al. | 399/179 |
| 5,907,758 | A * | 5/1999 | Tanaka et al. | 399/303 |
| 6,253,041 | B1 * | 6/2001 | Tomizawa et al. | 399/66 |
| 2005/0074250 | A1 * | 4/2005 | Nishiwaki et al. | 399/66 |

* cited by examiner

*Primary Examiner*—David M Gray
*Assistant Examiner*—Gregory H Curran

(57) ABSTRACT

Image transfer quality in an electrophotographic image forming device is improved by preconditioning a media sheet prior to transferring a toner image thereto at an image transfer station. The media sheet is preconditioned by applying a static charge to it. In a color DTM type device, the charge reduces the transfer voltages required at downstream image transfer stations to account for charge accumulated on the media sheet as a result of the image transfer process at upstream image transfer stations. The charge may be applied to the media sheet at a media sheet preconditioning element positioned upstream of an image transfer station. Alternatively, an initial charge may be applied to the media sheet at an image transfer station, without transferring a toner image to the sheet, and returning the sheet via a duplex path to positioned upstream of an image transfer station prior to an image transfer operation.

6 Claims, 7 Drawing Sheets

PRECONDITIONING MEDIA SHEETS TO REDUCE TRANSFER VOLTAGE

BACKGROUND

The present invention relates generally to electrophotographic image forming devices, and in particular to preconditioning media sheets to reduce the required transfer voltage.

Electrophotographic image forming devices, such as laser printers, are well known in the art and widely deployed. Color electrophotographic image forming devices form a plurality of latent electrostatic images, develop each color plane image with toner particles, and ultimately transfer the color plane images to a media sheet and then fuse them to the media sheet using heat and pressure. Color electrophotographic image forming devices may be divided into to types by considering how toner is transferred to media sheets. In a direct to media (DTM) type image forming device, the developed toner image of each color plane is successively transferred directly to the media sheet. In an intermediate transfer mechanism (ITM) type image forming device, the developed toner image of each color plane is successively transferred to an intermediate mechanism, such as a belt, and then the full-color image is transferred to a media sheet.

One known problem that particularly affects DTM type image forming devices is that resistive media sheets become charged as they pass successively through high-voltage image transfer stations. Accordingly, to maintain high image transfer quality, the transfer voltage at downstream image transfer stations must be increased, to offset the effects of the media sheet accumulating ever-greater charge as it progresses through upstream image transfer stations. While this technique works well to preserve image transfer quality, there are practical limits to the voltage levels that downstream image transfer stations an employ. First, very high transfer voltages may require more expensive high-voltage power supplies. Second, at very high transfer voltages, air may ionize in the region surrounding downstream image transfer stations, a phenomenon known as Paschen breakdown. In Paschen breakdown, toner particles reverse polarity and their placement becomes unpredictable—a phenomenon known as backtransfer. Backtransfer detrimentally impacts image quality. Additionally, in some case monochrome DTM type and ITM type image forming devices may require very high transfer voltages, such as when transferring images to very highly resistive media.

SUMMARY

According to one or more embodiments disclosed and claimed herein, image transfer quality in an electrophotographic image forming device is improved by preconditioning a media sheet prior to directing the media sheet to a image transfer station for the transfer of toner images thereto. The media sheet is preconditioned by applying a static charge to it. In color DTM type devices, the charge reduces the transfer voltages required at downstream image transfer stations to account for charge accumulated on the media sheet as a result of the image transfer process at upstream image transfer stations. The charge may be applied to the media sheet at a media sheet preconditioning element positioned upstream of an image transfer station. In one embodiment, an initial charge may be applied to the media sheet at an image transfer station, without transferring a toner image to the sheet, and returning the sheet via a duplex path to positioned upstream of the image transfer prior to an image transfer operation.

One embodiment relates to a method of transferring a developed toner image to a media sheet in an image forming device. A media sheet is preconditioned prior to passing the media sheet through an image transfer station into the image forming device by applying an electrical charge to the media sheet. The media sheet is passed through an image transfer station in the image forming device. The image transfer station applies a lower transfer voltage than would be required or comparable image transfer quality without preconditioning the media sheet.

Another embodiment relates to an image forming device. The image forming device includes a media path and one or more image transfer stations. At least one power supply is connected to the image transfer stations. The image forming device further includes a controller operative to control the movement of a media sheet along the media path so as to precondition the media sheet by applying an electrical charge to the media sheet. The controller is further operative to apply a lower transfer voltage to one or more image transfer stations than would be required for comparable image transfer quality without preconditioning the media sheet.

Yet another embodiment relates to a method of transferring a toner image to a media sheet an image transfer station, the station operative to transfer a toner image from a surface charged to a first potential having a first polarity to the media sheet by the influence of a second surface charged to a second potential having a second polarity opposite the first polarity. The media sheet is preconditioned by charging it to the second polarity prior to entering an image transfer station. The image is transferred at a transfer voltage lower than a transfer voltage required to achieve the same image transfer quality without preconditioning the media sheet.

DETAILED DESCRIPTION

Figure 1:
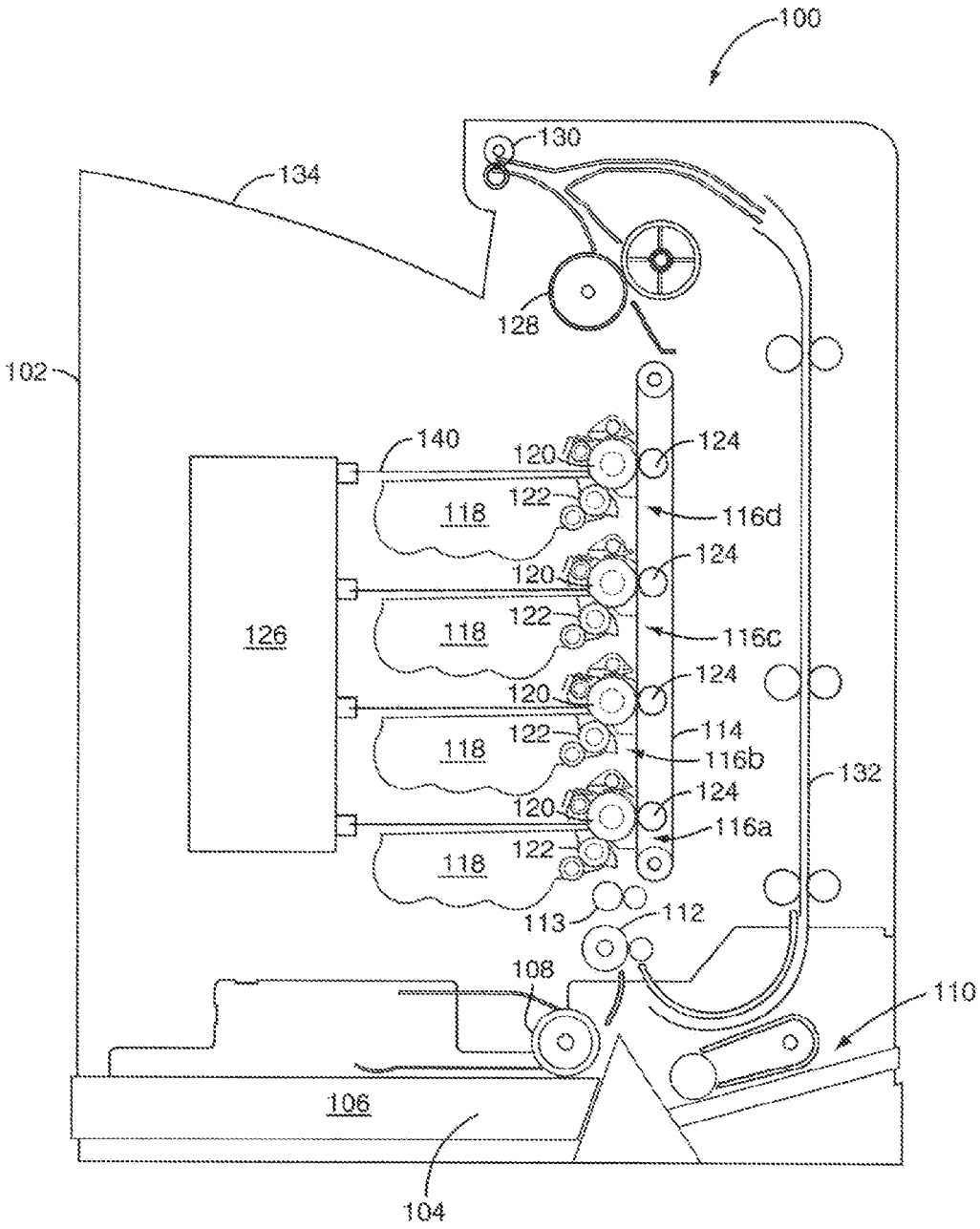
FIG. 1 is a functional block diagram of a color, DTM type electrophotographic image forming device having a media sheet preconditioning roller.

FIG. 1 depicts a DTM image forming device 100 used to precondition media sheets to achieve high image transfer quality of reduced transfer voltages. According to one embodiment of the present invention, the image forming device 100 is a color laser printer. Other examples of an image forming device include but are not limited to a fax machine, copier or any combination thereof. The image forming device 100 comprises a housing 102 and a media tray 104. The media tray 104 includes a main media sheet stack 106 with a sheet pick mechanism 108, and a multipurpose tray 110 for feeding envelopes, transparencies and the like. The media tray 104 may be removable for refilling, an located in a lower section of the device 100.

Within the image forming device housing 102, the image forming device 100 includes a media registration roller 112, a media sheet transport belt 114, and four image transfer stations 116*a*-116*d*, each comprising a removable developer cartridge 118, a photoconductive unit 120, a developer roller 122 and transfer roller 124. The image forming device 100 additionally includes an imaging device 126, a fuser 128, reversible exit rollers 130, and a duplex media sheet path 132, as well as various additional rollers, actuators, sensors, optics, and electronics (not shown) as are conventionally known in the image forming device arts, and which are not further explicated herein. The image transfer stations 100 are disposed along a vertical plane. However, it will be appreciated by those skilled in the art that the image transfer stations may be disposed along a horizontal plane or any other orientation. Additionally, the image forming device 100 includes one or more controllers, microprocessor, DSPs, or other stored-program processors (not shown) and associated computer memory, data transfer circuits, and/or the peripherals (not shown) that provide overall control of the image formation and transfer process. As described more fully herein, in one embodiment, the image forming device housing 102 includes a media sheet preconditioning element 113 operative to impart a preconditioning charge to a media sheet. In various embodiments, the preconditioning element 113 may comprise a roller, as depicted in FIG. 1, a blade, electrostatic brush, electrical field, or other mechanism known in the art to impart a charge to a media sheet.

Each developer cartridge 118 includes a reservoir containing toner and a developer roller 122, in addition to various rollers, paddles and other elements (not shown). Each developer roller 122 is adjacent to a corresponding photoconductive (PC) unit 120, with the developer roller 122 developing a latent image on the surface of the PC unit 120 by supplying toner. In various alternative embodiments, the PC unit 120 may be integrated into the developer cartridge 118, may be fixed in the image forming device housing 102, or may be disposed in a removable photoconductor cartridge (not shown). In a typical color DTM type image forming device, three or four colors of toner—cyan, yellow, magenta, and optionally black—are applied successively (and not necessarily in that order) to a print media sheet to create a color image. Correspondingly, FIG. 1 depicts four image transfer stations 116*a*-116*d*. In a monochrome printer, only one image transfer station 116 may be present.

The operation of the image forming device 100 is conventionally known. Upon command from control electronics, a single media sheet 142 is "picked," or selected, from either the primary media stack 106 or the multipurpose tray 110. Alternatively, a media sheet 142 may travel through the duplex path 132 for a two-sided print operation or reprinting on the first side. Regardless of its source, the media sheet 142 is presented at the nip of registration roller 112, which aligns the media sheet 142 and precisely times its passage on to the image forming stations downstream. As described herein, the media sheet 142 may be preconditioned by applying a charge thereto at the media sheet preconditioning element 113.

The media sheet 142 then contacts the transport belt 114, which carries the media sheet 142 successively past the image transfer stations 116*a*-116*d*. As described above, at each PC unit 120, a latent image is formed thereon by optical projection form the imaging device 126. The latent image is developed by applying toner to the PC unit 120 from the corresponding developer roller 122. The toner is subsequently deposited on the media sheet 142 as it is conveyed past the PC unit 120 by operation of a transfer voltage applied by the transfer roller 124. Each color is layered onto the media sheet 142 to form a composite image, as the media sheet 142 passes by each successive image transfer station 116.

The toner is thermally fused to the media sheet 142 by the fuser 128, and the sheet 142 then passes through reversible exit rollers 130, to land facedown in the output stack 134 formed on the exterior of the image forming device housing 102. Alternatively, the exit rollers 130 may reverse motion after the trailing edge of the media sheet 142 has passed the entrance to the duplex path 132, directing the media sheet 142 through the duplex path 132 for the printing of another image on the back side thereof.

Figure 2:
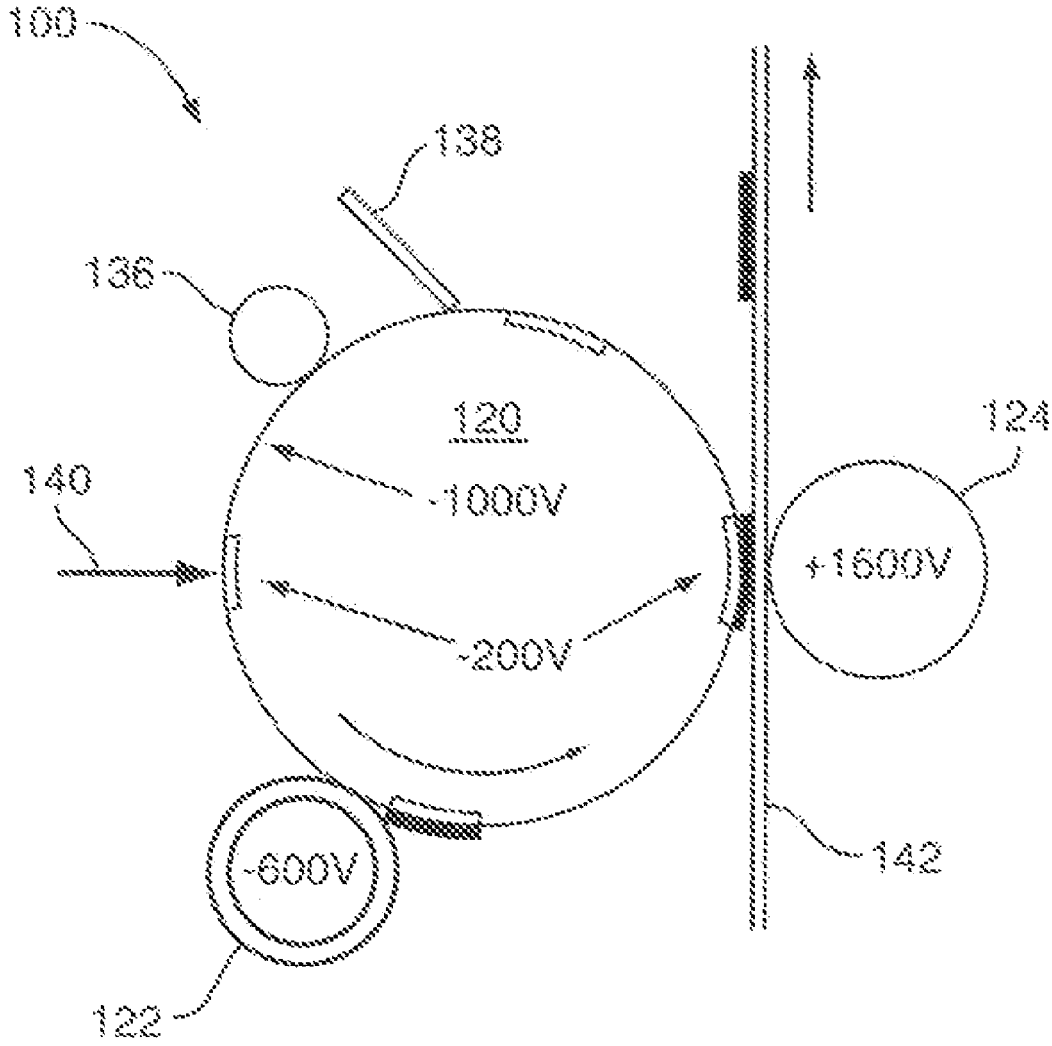
FIG. 2 (PRIOR ART)
FIG. 2 is a functional block diagram of an image transfer station in a DTM type electrophotographic image forming device.

FIG. 2 is a schematic diagram illustrating an exemplary image transfer station 116. As described above, each image transfer station 116 includes a photoconductive (PC) unit 120, a charging unit 136, a developer roller 122, a transfer roll 124, and a cleaning blade 138. The PC unit 120 is cylindrically shaped an illustrated as a drum. However, it will be apparent to those skilled in the art that the PC unit 120 may comprise any appropriate structure. The charging unit 136 charges the surface of the PC unit 120 to a generally uniform negative potential, such as approximately −1000 volts (V). A laser beam 140 from the imaging device 126 (see FIG. 1) selectively discharges areas on the PC unit 120 to form a latent image on the surface of the PC unit 120. The areas of the PC unit 120 illuminated by the laser beam 140 are discharged, resulting in a potential of approximately −200 V. The transfer roller 124 is charged to an appropriate positive potential, such as +1600 V.

The potential of the transfer roller 124 may vary depending on the type of media sheet 142, the electrical or other property of the toner being applied to the media sheet 142, and other factors. The developer roller 122 transfers negatively-charged toner having a core voltage of approximately −600 V to the surface of the PC unit 120, to develop the latent image on the PC unit 120. The toner is attracted to the most positive surface, i.e., the area discharged by the laser beam 140 and is repelled by more-negatively charged areas of the PC unit 120 (i.e. those not optically discharged). As the PC unit 120 rotates, a positive voltage field produced by the transfer device 124 attracts and transfers the toner adhering to the discharged areas on the surface of the PC unit 120 to a media sheet 142. Any remaining toner on the PC unit 120 is then removed by the cleaning blade 138. The toner thus experiences a relative potential difference of 400 V between the developer roller 122 and the PC drum 120, and a potential difference of 1800 V between the PC unit 120 and the transfer roller 124.

The image transfer process is complex, and is sensitive to many inputs. The operating environment (temperature, humidity, and the like), transfer belt 114 properties, PC unit 120 characteristics, toner formulation, media sheet 142 properties, and other factors all influence image quality. All of these inputs may directly impact the electrical potential across toner transfer boundaries in a image transfer station 116. In particular, the resistivity of media sheets 142 gives rise to the media sheets 142 collecting charge as they progress through the upstream image transfer stations 116*a*-116*c*.

Figure 3:
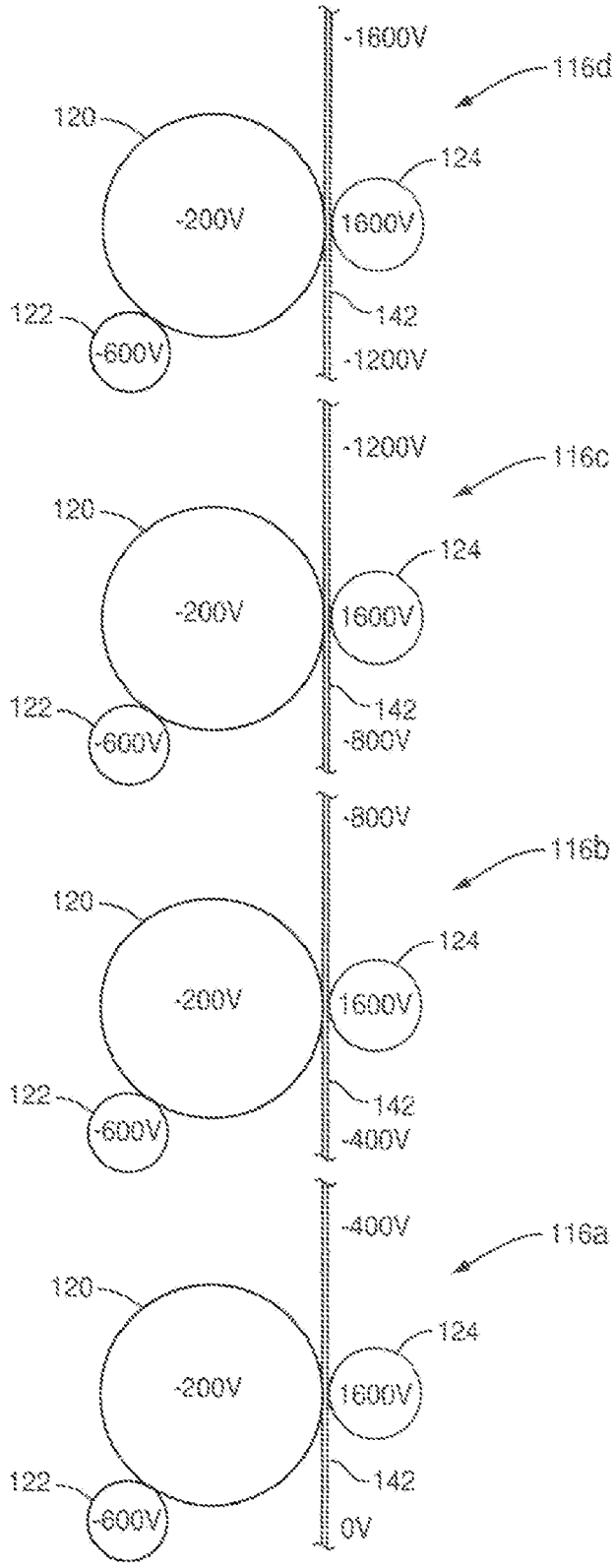
FIG. 3 (PRIOR ART)
FIG. 3 is a block diagram depicting the accumulation of charge on a media sheet as it passes through image transfer stations.

Image transfer quality depends on the potential difference between the media sheet 142 and the discharged areas of the surface of the PC unit 120 (hereinafter referred to as simply the potential of the PC unit 120). In the example depicted on FIG. 2, efficient transfer occurs at a potential difference of 1800 V. Transfer will be inefficient at lower electrical potentials. Since resistive media sheets 142 retain charge at each station, the available electrical potential difference at each station declines. FIG. 3 depicts this phenomenon. In FIG. 3, all four image transfer stations 116*a*-116*d* use the voltages depicted in FIG. 2. A media sheet 142 enters image transfer station 116*a* with a charge of 0 V. The media sheet 142 experiences a potential difference between the PC unit 120 (−200 V) and transfer roller 124 (1600 V) of 1800 V, which is sufficient to acceptable image transfer quality. The media sheet 142 exits the image transfer station 116*a* retaining a charge of −400V. When it enters the image transfer station 116*b*, the retained charge of −400V reduces the nominal PC-to-transfer roller potential difference of 1800 V to only 1400 V, which may be insufficient for acceptable image transfer quality.

Furthermore, the media sheet 142 retains an additional −400V charge, and exits the image transfer station 116*b* carrying a charge of −800V. When the media sheet 142 enters the image transfer station 116*c* with a charge of −800V, if reduces the transfer potential to 1000 V. Similarly, as the media sheet 142 exists the image transfer station 116*c* and enters the image transfer station 116*d* carrying a charge of −1200V, the charge reduces the nominally 1800 V transfer potential to only 600 V.

In some embodiments, the media sheet 142 will be present in two or ore image transfer stations 116*a*-116*d* at the same time. Accordingly, the charges depicted in FIG. 3 may be carried by one or more portions of a single media sheet 142. For highly resistive media the charge does not migrate significantly; therefore migration of the charge within a media sheet 142 is not considered in this discussion. Alternatively, the image transfer stations 116*a*-116*d* may be sufficiently separated along a media path such that a media sheet 142 is present in only one image transfer station 116*a*-116*d* at any given time. In this case, the effects depicted in FIG. 3 are still obtained, assuming that the image transfer stations 116*a*-116*d* are sufficiently close together that the charge on a media sheet 142 does not bleed off appreciably between image transfer stations 116*a*-116*d*.

Conventionally, color DTM image forming devices have resolved this electrical potential degradation by increasing the transfer voltage of each successive downstream transfer station 116*b*-116*d* to compensate for charge retention. FIG. 5 depicts one example of this approach. To maintain a sufficient electrical potential difference between the media sheet 142 and the PC unit 120 at each transfer station 116*a*-116*d*, the transfer voltage at each downstream transfer station 116*b*-116*d* is increased by an amount equal to or greater than the retained charge. The charge retained by the media sheet 142 will vary according to the operating environment, the media sheet 142 properties, and various other factors. For the example depicted in FIG. 4, a charge retention equal to one fourth of the transfer voltage is assumed.

The first image transfer station 116*a* is configured as in the embodiment depicted in FIGS. 2 and 3, and the media sheet 142 experiences an 1800 V transfer potential relative to the PC unit 120. The media sheet 142 exits the image transfer station 116*a* retaining a charge of −400V. The transfer voltage at image transfer station 116*b* is increased to 2000 V, providing a nominal 2200 V transfer potential, which the −400 V charge on the media sheet 142 reduces to 1800 V. The media sheet 142 exits the image transfer station 116*b* with an additional −500V of charge, for a total of −900V. To account for the −900V charge on the media sheet 142, the transfer roller voltage at image transfer station 116*c* is increased to 2500 V, providing a nominal transfer potential with respect to the PC unit 120 of 2700 V, which is reduced by the media sheet charge to 1800 V. The media sheet 142 exits the image transfer station 116*c* with a charge of −1525V. Accordingly, the nominal transfer roller 124 voltage at the image transfer station 116*d* is set to 3125 V, providing a nominal transfer potential 3325 V. This is reduced by the −1525 charge on the media sheet 142, resulting in an effective transfer voltage of 1800 V.

Figure 4:
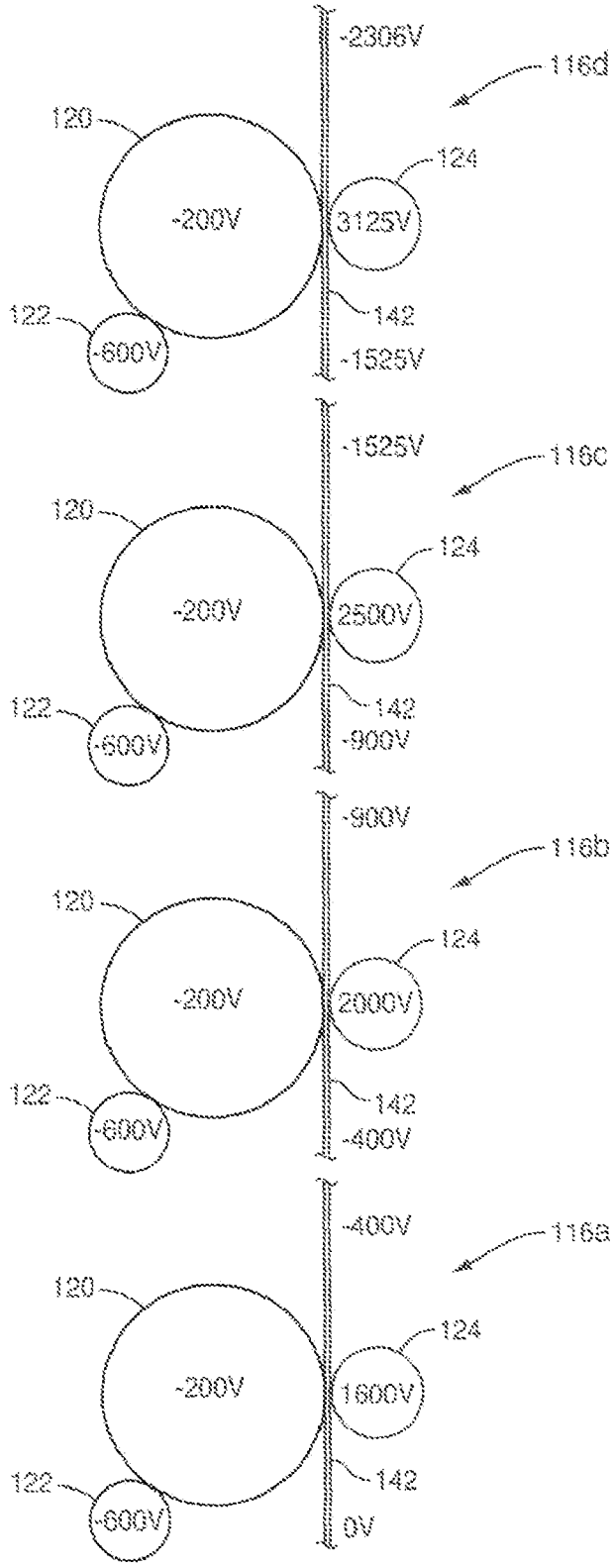
FIG. 4 (PRIOR ART)
FIG. 4 is a block diagram of the transfer voltages applied at successive image transfer stations to counter deleterious effects of charge accumulation on a media sheet.
Figure 5:
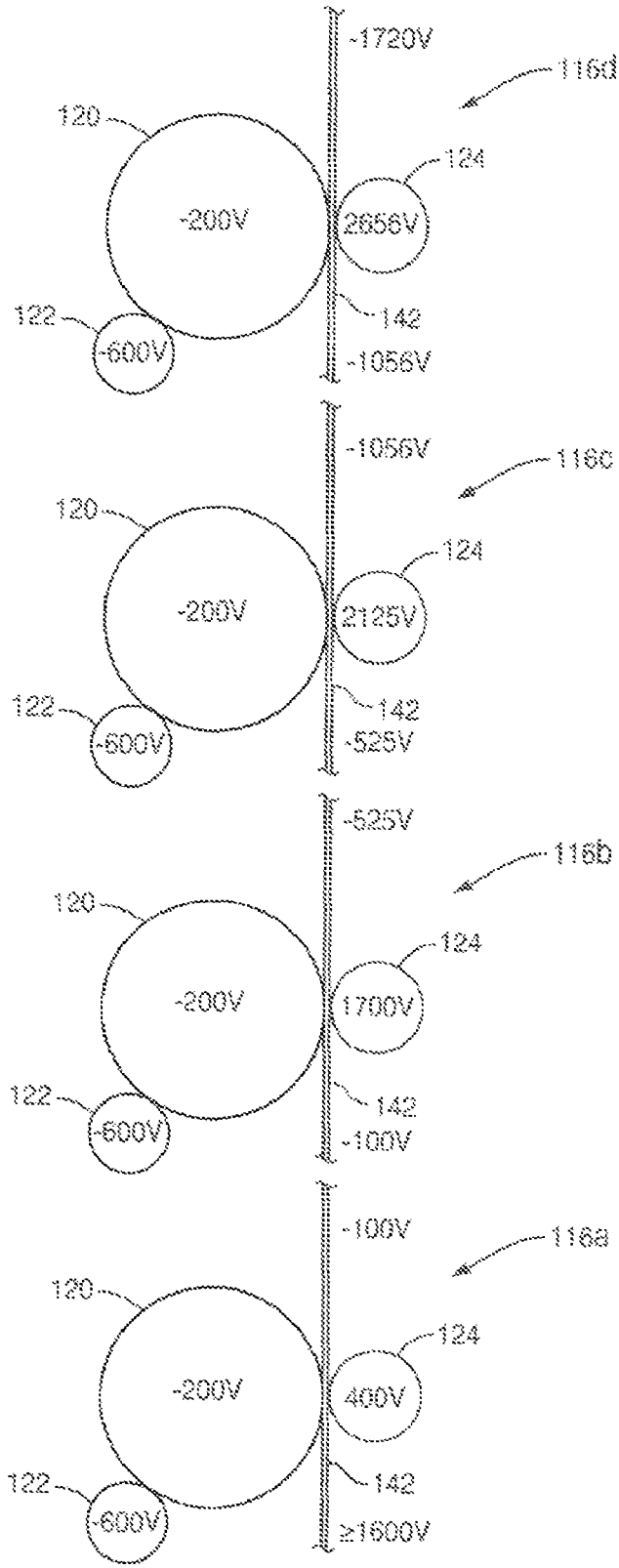
FIG. 5 is a block diagram depicting the lower transfer voltages required when the media sheet is preconditioned to carry an initial charge.

While the embodiment of FIG. 4 maintains an effective transfer voltage between the media sheet 142 an the PC unit 120 of 1800 V, the voltage applied to transfer roller 124 at the image transfer station 116*d* is over 3000V—more than 1500 V greater than the 1600 V transfer roller 124 voltages of FIGS. 2 and 3. Such a high voltage will likely require a larger and more expensive power supply, adversely affecting system design and affordability. In addition, at such high voltages, Paschen breakdown may occur, leading to toner backtransfer, which degrades image quality.

According to one or more embodiments of the present invention, excessive downstream image transfer voltages are avoided, while maintaining a sufficient effective transfer voltage to achieve acceptable image quality, by preconditioning the media sheet 142 by applying a positive charge to it. FIG. 5 demonstrates this solution, in an embodiment where the charge is applied to the media sheet 142 prior to entering the first image transfer station 116*a*. The media sheet 142 is preconditioned to retain a charge of, e.g., 3000 V prior to entering the first image transfer station 116*a*. This provides an effective transfer voltage of 3200 V, well in excess of the 1800 V needed for acceptable image quality. Note that the preconditioning charge may be at any level in excess of the 1600 V required to achieve an effective transfer voltage of at least 1800 V. Since charge may bleed off of a media sheet 142 in an unpredictable manner, the preconditioning charge may advantageously be greater than 1800 V. In one embodiment, the preconditioning charge is simply the highest voltage that an available power supply can provide. Given the teachings of the present disclosure, those of skill in the art may readily determine an optimal preconditioning charge for a media sheet 142 for any given application, in view of the media sheet 142 characteristics, operating conditions, existing power supply configurations, and other relevant considerations.

The transfer voltage at the transfer roller 124 at image transfer station 116*a* is set to 400V. This charges the media sheet 142 to −100 V as it exits the image transfer station 116*a*. The transfer voltage analysis through the remaining image transfer stations 116*a*-116*d* is similar to that of FIG. 3. The transfer voltage at the transfer roller 124 at image transfer station 116*b* is set to 1700 V, providing a nominal transfer potential of 1900 V, which is reduced by the −100 V charge on the media sheet 142 to an effective transfer potential of 1800 V. The media sheet 142 exits the image transfer station 116*b* with a charge of −525 V.

The transfer voltage of the transfer roller 124 of image transfer station 116*c* is set to 2125 V to provide a nominal transfer potential of 2325 V, which is reduced by the −525 V charge on the media sheet 142 to an effective transfer potential of 1800 V. The media sheet 142 exits the image transfer station 116*c* with a charge of −1056 V. Finally, the transfer voltage of the transfer roller 124 of image transfer station 116*d* is set to 2656 V to provide a nominal transfer potential of 2856 V, which is reduced by the −1056 V charge on the media sheet 142 to an effective transfer potential of 1800 V.

The transfer voltages at the transfer rollers 124 of the downstream image transfer stations 116*b*-116*d* are increased to offset the deleterious effects of charge accumulation in the media sheet 142. However, by precharging the media sheet 142 to a positive voltage level, the level of compensation transfer voltage required at each successive image transfer station 116*b*-116*d* is less than required in prior art solution without preconditioning, such as depicted in FIG. 4. In particular, note that the transfer voltage of the final image transfer station 116*d* is considerably below 3000 V. This not only may allow the image forming device 100 to include smaller and more economical power supplies, but additionally avoids Paschen breakdown and concomitant toner backtransfer, thus improving image transfer quality.

While FIG. 5 depicts preconditioning the media sheet 142 prior to entering the first image transfer station 116*a*, the present invention is not limited to this embodiment. The media sheet 142 may be advantageously preconditioned by applying a charge thereto prior to entering any image transfer station 116*a*-116*d*.

Figure 7:
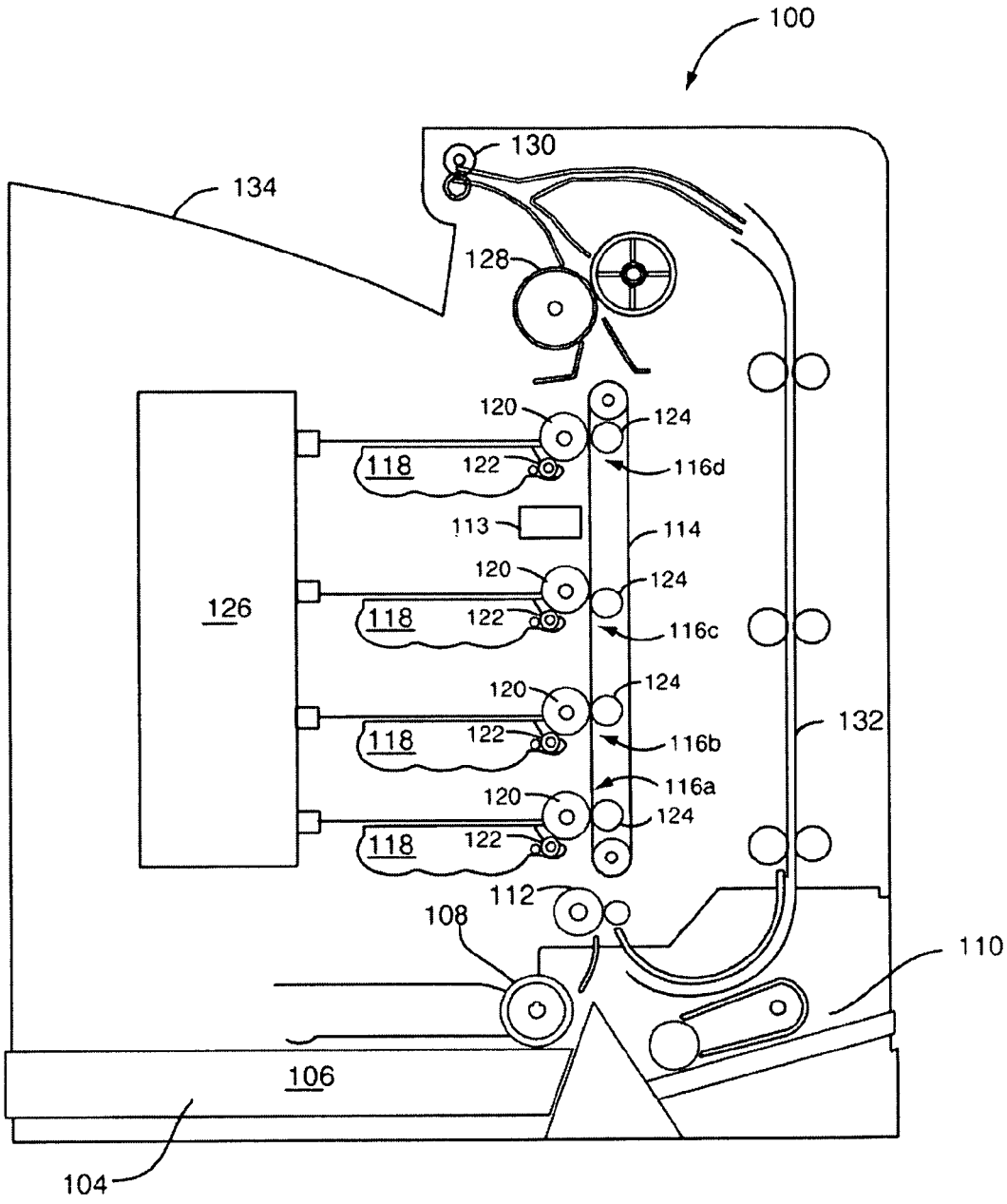
FIG. 7 is a functional block diagram of a color, DTM type electrophotograghic image forming device having a media sheet preconditioning element.

The media sheet 142 may be preconditioned in a variety of ways. In one embodiment, a media sheet preconditioning element 113 comprising a roller is charged to, or somewhat in excess of, the desired preconditioning charge on the media sheet 142. In the embodiment depicted in FIG. 1, the media sheet preconditioning element 113 is positioned in the media path upstream of then first image transfer station 116*a*. In other embodiments, the media sheet preconditioning element 113 may be located anywhere along the media path, and in particular may be located in between any of the two image transfer stations 116 (e.g. as depicted in FIG. 7). An image forming device 100 may include one or more media sheet preconditioning elements 113. In various embodiments, the media sheet preconditioning element 113 may comprise a blade, electrostatic brush, electrical field, or other mechanism known in the art to impart a charge to a media sheet 142, rather than the roller 113 (as depicted in FIG 7).

In an embodiment lacking a media sheet preconditioning element 113, a media sheet 142 may be directed through the image transfer stations 116*a*-116*d* without transferring any image thereto. At one or more image transfer station 116*a*-116*d*, the media sheet 142 is preconditioned by charging the media sheet 142 with a transfer roller 124. In one embodiment, the transfer roller 124 of the furthest downstream image transfer station 116*d* is utilized to precondition the media sheet 142. The preconditioned media sheet 142 is then directed down the duplex path 132, and again positioned upstream of the image transfer stations 116*a*-116*d*, to begin the image transfer process from a preconditioned state. In this embodiment, the media sheet 142 may be charged to a very high voltage, for example, 3000 V. Much of this charge will bleed off of the media sheet 142 as it transits the duplex path 132, resulting in charge of, e.g., 1000V at the entry to the image transfer stations 116*a*-116*d*.

Embodiments that precondition a media sheet 142 using an image transfer station 116*a*-116*d* and the duplex path 132 present the significant advantage of not requiring a media sheet preconditioning element 113 an these embodiments may hence be implemented on existing and deployed image forming devices 100, such as via a software upgrade. Image transfer quality may additionally be improved in one or more of these embodiments by removing moisture from the media sheet 142 in the fuser 128 prior to image transfer. As still another advantage, the duplex function may act as a decurling mechanism, further enhancing image quality. On the other hand, the requirement of transversing the duplex path 132 may introduce an unacceptable delay in throughput.

Figure 6:
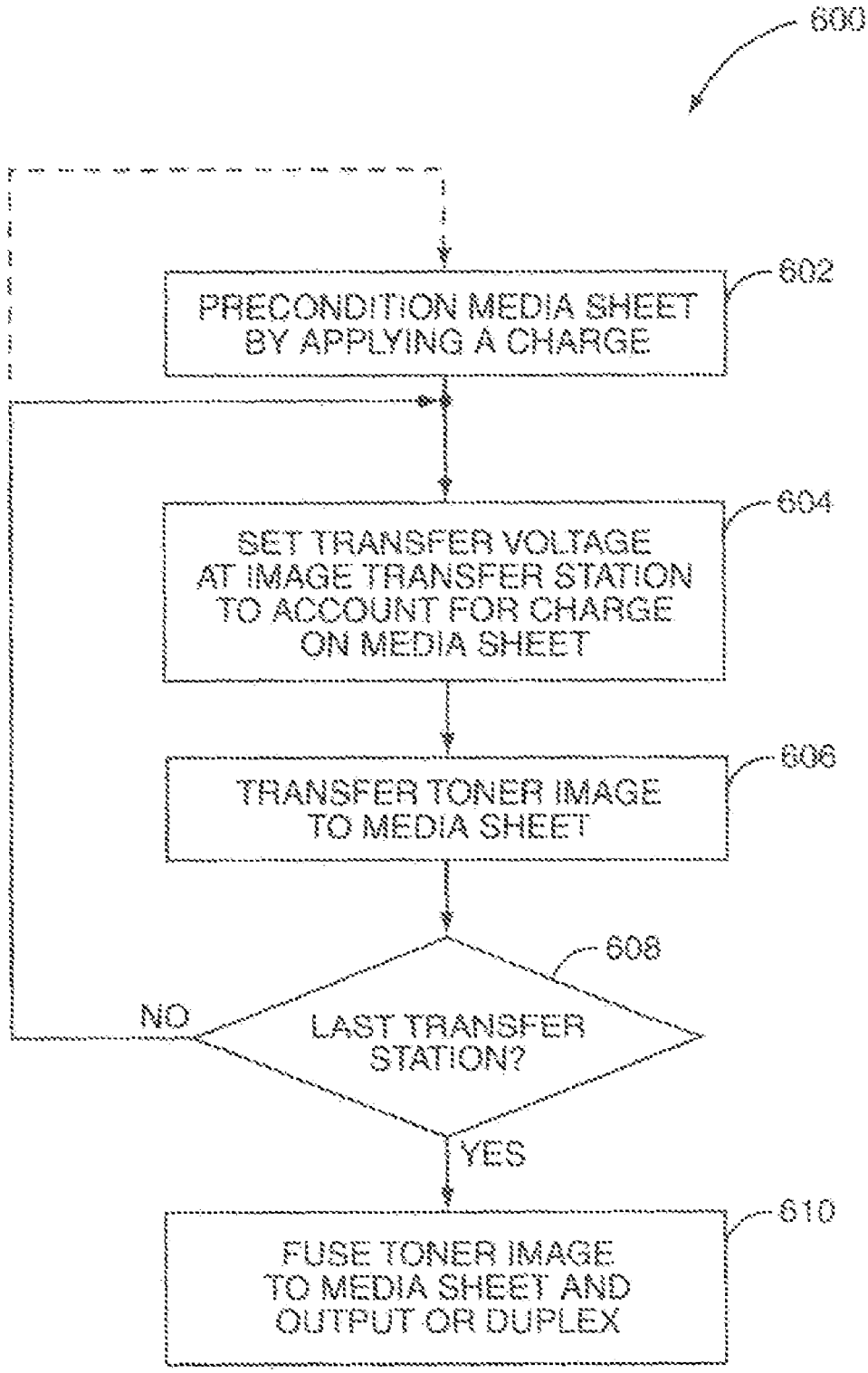
FIG. 6 is a flow diagram of a method of transferring two or more developed toner images to a media sheet in an image forming device.

FIG. 6 depicts a method 600 of transferring two or more developed toner images to a media sheet 142 in a color DTM type image forming device 100. A media sheet 142 is preconditioned (block 602) by applying a charge thereto. The charge may be applied by a media sheet preconditioning element 113, or may be applied to an image transfer station (e.g., 116*d*) without transferring a toner image, with the media sheet 142 subsequently directed down the duplex path 130 to place it upstream of the image transfer stations 116*a*-116*d*. The voltage on the transfer roller 124 at each image transfer station 116 is set (block 604) to account for charge on the media sheet 142, such as that generated by an upstream image transfer station 116*a*-116*c* in the case of downstream image transfer stations 116*b*-116*d*. The transfer roller 124 charges are lower than would be required for comparable image transfer quality without preconditioning the media sheet 142.

A toner image is transferred to the media sheet 142 (block 606) at each image transfer station 116*a*-116*d*. This process repeats (block 608) for each image transfer station 116*a*-116*d* in the image forming device 100. Where only an initial preconditioning element 113 is disposed upstream of the image transfer stations 116*a*-116*d*, the method 600 follows the solid-line path to step 604 at each successive image transfer station 116. In an embodiment having a preconditioning element 113 located between some or all of the image transfer stations 116*a*-116*d*, the method 600 follows the dotted-line path to step 602 at each successive image transfer station 116. The composite toner image is then fused to the media sheet 142 at the fuser 128, and the media sheet 142 is output to the tray 134 or enters the duplex path 132 for printing on the reverse side thereof (block 610).

While described herein with reference to a color DTM type image forming device, the present invention is not so limited. For example, the imaging may advantageously be utilized in monochrome DTM type and ITM type image forming devices, for example when transferring images to highly resistant media, and/or when transfer voltages are limited by small power supplies. In general, the present invention is widely applicable to any electrophotographic image forming device.

The present invention may, of course, be carried out in other ways than those specifically set forth herein without departing from essential characteristics of the invention. The present embodiment are to be considered in all respects as illustrative and not restrictive, and all changes coming within the meaning and equivalency range of the appended claims are intended to be embraced therein.

What is claimed is:

1. A method of transferring a developed toner image to a media sheet in an image forming device, comprising:

passing a media sheet through one or more image transfer stations in the image forming device and forming an image on the media sheet, the one or more image transfer stations applying a lower transfer voltage than would be required without preconditioning the media sheet; and prior to passing the media sheet through a most upstream image transfer station and forming an image on the media sheet, preconditioning the media sheet by applying an electrical charge to the media sheet, comprising passing the media sheet through at least one of the one or more image transfer stations, without transferring an image thereto but applying the electrical charge to the media sheet, and positioning the media sheet upstream of the most upstream image transfer station via a duplex path.

2. The method of claim 1 wherein applying the electrical charge to the media sheet at the at least one image transfer station comprises applying the electrical charge to the media sheet at the furthest downstream image transfer station.

3. The method of claim 2 wherein the applied electrical charge is about 3000 V.

4. An image forming device, comprising:

a media path;

one or more image transfer stations;

at least one power supply connected to the one or more image transfer stations; and a controller operative to control the movement of a media sheet along the media path so as to precondition the media sheet prior to passing the media sheet through a most upstream image transfer station and causing image transfer, by applying an electrical charge to the media sheet, the controller further operative to apply a lower transfer voltage to the one or more image transfer stations than would be required without preconditioning the media sheet, wherein the controller is operative to pass the media sheet through at least one or more image transfer stations, without transferring an image thereto but applying the electrical charge to the media sheet, and positioning the media sheet upstream of the most upstream image transfer station via a duplex path.

5. The image forming device of claim 4 wherein the controller is operative to precondition the media sheet by applying the electrical charge to the media sheet at the furthest downstream transfer station.

6. A method of transferring a toner image to a media sheet at an image transfer station, the station operative to transfer a toner image from a surface charged to a first potential having a first polarity to the media sheet by the influence of a second surface charged to a second potential having a second polarity opposite the first polarity, comprising:

preconditioning the media sheet by charging the media sheet at the second polarity prior to entering an image transfer station and prior to any toner being applied to the media sheet; and transferring the image at a transfer voltage lower than a transfer voltage required without preconditioning the media sheet, wherein preconditioning the media sheet comprises passing the media sheet through the image transfer station, without transferring an image thereto but applying an electrical charge to the media sheet at the image transfer station, and positioning the media sheet upstream of the image transfer station via a duplex path.

* * * * *